US006233751B1

(12) United States Patent
Ford

(10) Patent No.: US 6,233,751 B1
(45) Date of Patent: May 22, 2001

(54) TOILET FLUSHING AND SEAT LIFTING SYSTEM

(76) Inventor: Patrick J. Ford, 1061 Mira Mar, Long Beach, CA (US) 90804

( * ) Notice: Subject to any disclaimer, the term of this patent is extended or adjusted under 35 U.S.C. 154(b) by 0 days.

(21) Appl. No.: 09/519,755

(22) Filed: Mar. 6, 2000

(51) Int. Cl.[7] ..... A47K 13/10
(52) U.S. Cl. ..... 4/246.5; 4/246.1; 4/249
(58) Field of Search ..... 4/246.3, 246.4, 4/246.5, 249, 411

(56) References Cited

U.S. PATENT DOCUMENTS 1,999,070 * 4/1935 Svedelius ..... 4/246.5
4,030,146 * 6/1977 Pilkington et al. ..... 4/246.5
5,404,595 * 4/1995 Carmel ..... 4/246.1

FOREIGN PATENT DOCUMENTS

824778 * 12/1951 (DE) ..... 4/411

* cited by examiner

*Primary Examiner*—Robert M. Fetsuga

(57) ABSTRACT

A toilet flushing and seat lifting system for lifting a toilet seat and flushing the toilet seat without having to touch the toilet seat or handle. The toilet flushing and seat lifting system includes a lifting means for lifting the seat and lid of a toilet. The lifting means has a foot pedal. The foot pedal is elongate and has a first and second end. The foot pedal is generally positioned adjacent to the bottom side of the toilet. A pivoting means pivots the foot pedal with respect to floor. An elongate member has a first end and a second end. The first end of the elongate member is hingedly coupled to the second end of the foot pedal. A rod has a first end coupled to the second end of the elongate member and a second end extending toward the toilet. A securing means hingedly secures the second end of the rod to a bottom side of the seat. A toilet flushing means for flushing the toilet comprises an elongate flexible member having a first end and a second end. The first end is coupled to the handle, and the second end has a ring thereon.

12 Claims, 3 Drawing Sheets

TOILET FLUSHING AND SEAT LIFTING SYSTEM

BACKGROUND OF THE INVENTION

1. Field of the Invention

The present invention relates to toilet seat lifting devices and more particularly pertains to a new toilet flushing and seat lifting system for lifting a toilet seat and flushing the toilet seat without having to touch the toilet seat or handle.

2. Description of the Prior Art

The use of toilet seat lifting devices is known in the prior art. More specifically, toilet seat lifting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,327,859; U.S. Pat. No. 5,103,506; U.S. Pat. No. 330,411; U.S. Pat. No. 5,594,958; U.S. Pat. No. 5,742,949; and U.S. Pat. No. 5,101,518.

While these devices fulfill their respective, particular objectives and requirements, the aforementioned patents do not disclose a new toilet flushing and seat lifting system. The inventive device includes a lifting means for lifting the seat and lid of a toilet. The lifting means has a foot pedal. The foot pedal is elongate and has a first and second end. The foot pedal is generally positioned adjacent to the bottom side of the toilet. A pivoting means pivots the foot pedal with respect to floor. An elongate member has a first end and a second end. The first end of the elongate member is hingedly coupled to the second end of the foot pedal. A rod has a first end coupled to the second end of the elongate member and a second end extending toward the toilet. A securing means hingedly secures the second end of the rod to a bottom side of the seat. A toilet flushing means for flushing the toilet comprises an elongate flexible member having a first end and a second end. The first end is coupled to the handle, and the second end has a ring thereon.

In these respects, the toilet flushing and seat lifting system according to the present invention substantially departs from the conventional concepts and designs of the prior art, and in so doing provides an apparatus primarily developed for the purpose of lifting a toilet seat and flushing the toilet seat without having to touch the toilet seat or handle.

SUMMARY OF THE INVENTION

In view of the foregoing disadvantages inherent in the known types of toilet seat lifting devices now present in the prior art, the present invention provides a new toilet flushing and seat lifting system construction wherein the same can be utilized for lifting a toilet seat and flushing the toilet seat without having to touch the toilet seat or handle.

The general purpose of the present invention, which will be described subsequently in greater detail, is to provide a new toilet flushing and seat lifting system apparatus and method which has many of the advantages of the toilet seat lifting devices mentioned heretofore and many novel features that result in a new toilet flushing and seat lifting system which is not anticipated, rendered obvious, suggested, or even implied by any of the prior art toilet seat lifting devices, either alone or in any combination thereof.

To attain this, the present invention generally comprises a lifting means for lifting the seat and lid of a toilet. The lifting means has a foot pedal. The foot pedal is elongate and has a first and second end. The foot pedal is generally positioned adjacent to the bottom side of the toilet. A pivoting means pivots the foot pedal with respect to floor. An elongate member has a first end and a second end. The first end of the elongate member is hingedly coupled to the second end of the foot pedal. A rod has a first end coupled to the second end of the elongate member and a second end extending toward the toilet. A securing means hingedly secures the second end of the rod to a bottom side of the seat. A toilet flushing means for flushing the toilet comprises an elongate flexible member having a first end and a second end. The first end is coupled to the handle, and the second end has a ring thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet flushing and seat lifting system apparatus and method which has many of the advantages of the toilet seat lifting devices mentioned heretofore and many novel features that result in a new toilet flushing and seat lifting system which is not anticipated, rendered obvious, suggested, or even implied by any of the prior art toilet seat lifting devices, either alone or in any combination thereof.

It is another object of the present invention to provide a new toilet flushing and seat lifting system which may be easily and efficiently manufactured and marketed.

It is a further object of the present invention to provide a new toilet flushing and seat lifting system which is of a durable and reliable construction.

An even further object of the present invention is to provide a new toilet flushing and seat lifting system which is susceptible of a low cost of manufacture with regard to both materials and labor, and which accordingly is then susceptible of low prices of sale to the consuming public, thereby making such toilet flushing and seat lifting system economically available to the buying public.

Still yet another object of the present invention is to provide a new toilet flushing and seat lifting system which provides in the apparatuses and methods of the prior art some of the advantages thereof, while simultaneously overcoming some of the disadvantages normally associated therewith.

Still another object of the present invention is to provide a new toilet flushing and seat lifting system for lifting a toilet seat and flushing the toilet seat without having to touch the toilet seat or handle.

Yet another object of the present invention is to provide a new toilet flushing and seat lifting system which includes a lifting means for lifting the seat and lid of a toilet. The lifting means has a foot pedal. The foot pedal is elongate and has a first and second end. The foot pedal is generally positioned adjacent to the bottom side of the toilet. A pivoting means pivots the foot pedal with respect to floor. An elongate member has a first end and a second end. The first end of the elongate member is hingedly coupled to the second end of the foot pedal. A rod has a first end coupled to the second end of the elongate member and a second end extending toward the toilet. A securing means hingedly secures the second end of the rod to a bottom side of the seat. A toilet flushing means for flushing the toilet comprises an elongate flexible member having a first end and a second end. The first end is coupled to the handle, and the second end has a ring thereon.

Still yet another object of the present invention is to provide a new toilet flushing and seat lifting system that allows the user of the toilet to avoid exposure to germs on a toilet seat.

Even still another object of the present invention is to provide a new toilet flushing and seat lifting system that guard wall to protect the securing means from foreign substances.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
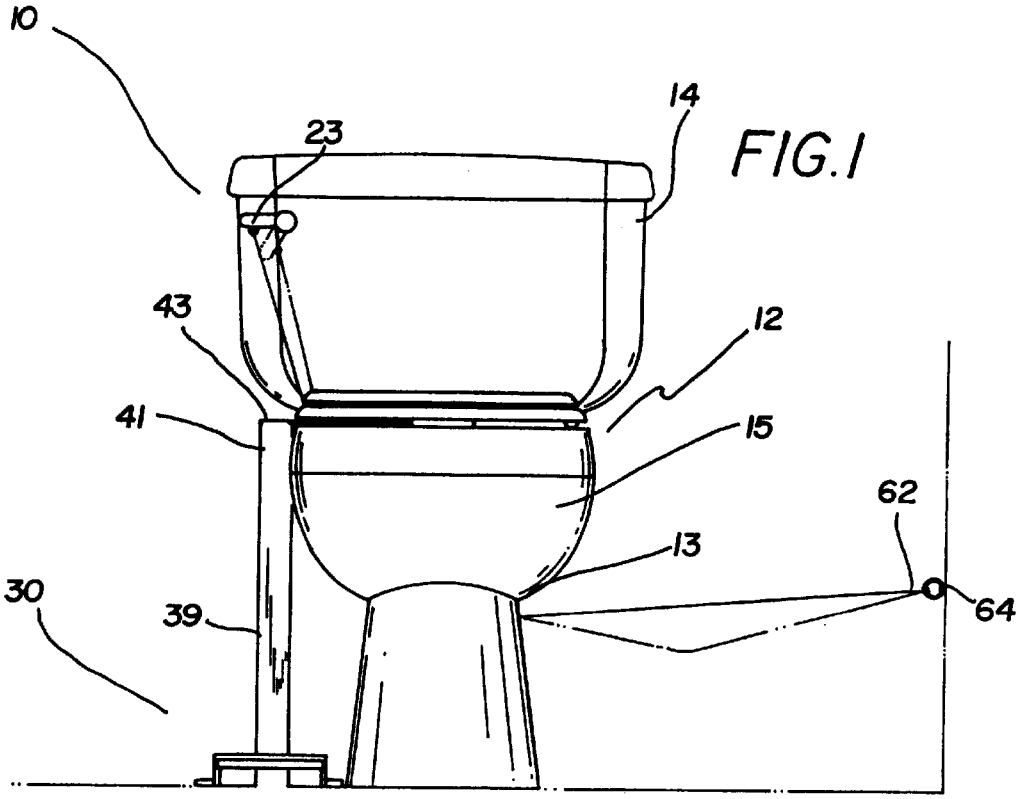
FIG. 1 is a schematic front view of a new toilet flushing and seat lifting system according to the present invention.
Figure 2:
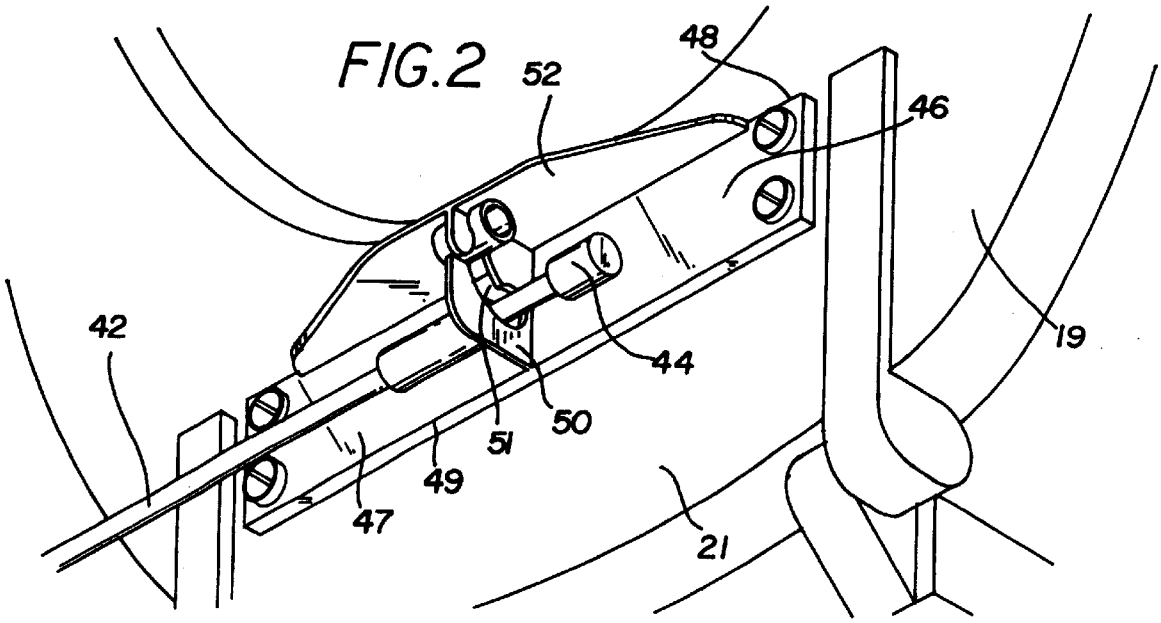
FIG. 2 is a schematic perspective view of the securing means of the present invention.
Figure 3:
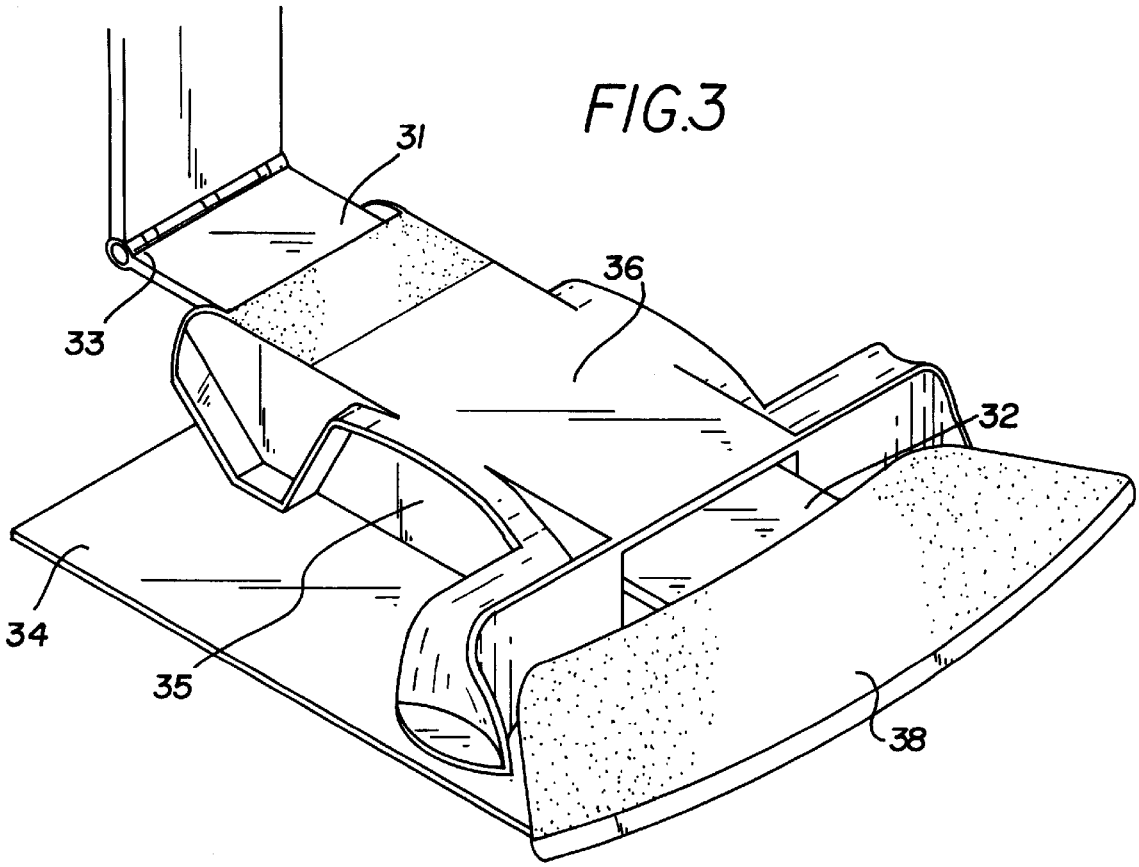
FIG. 3 is a schematic perspective view of the foot pedal and housing of the present invention.
Figure 4:
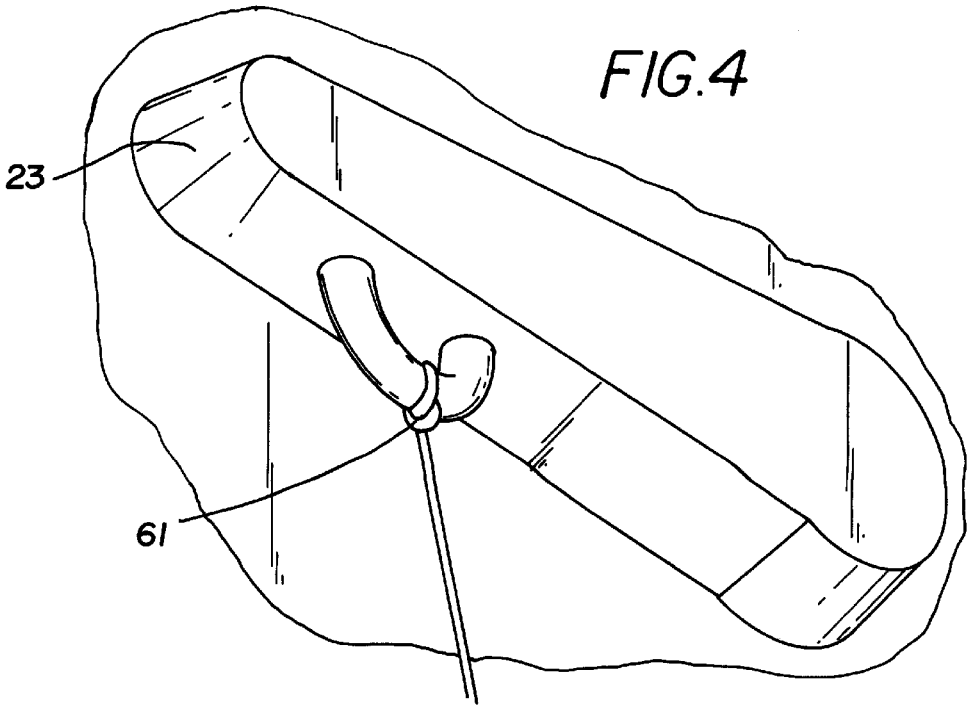
FIG. 4 is a schematic perspective view of the handle of the toilet of the present invention.
Figure 5:
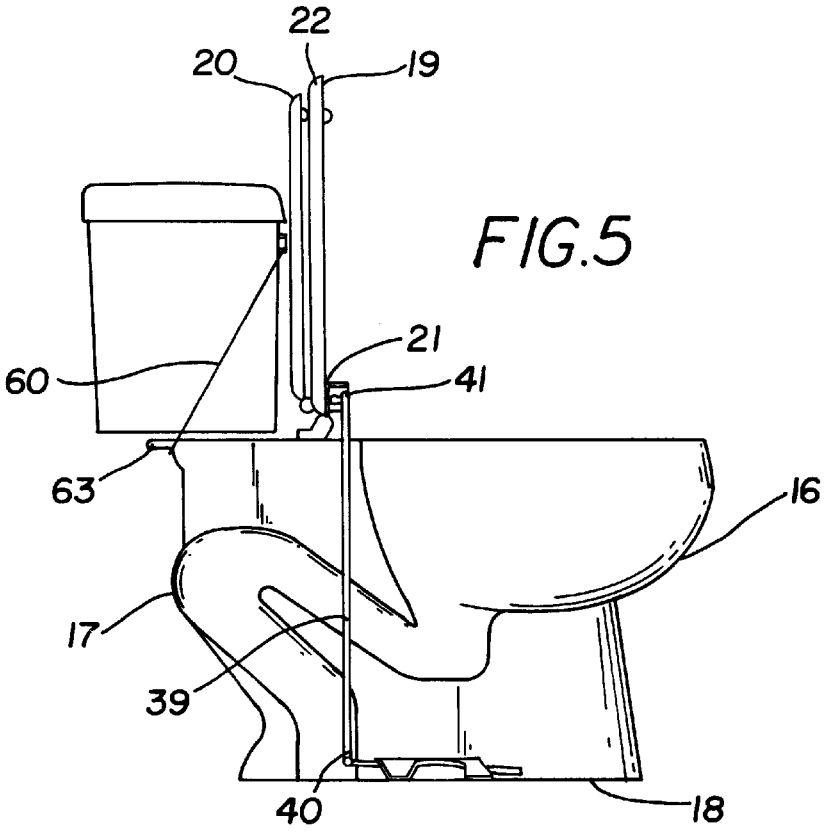
FIG. 5 is a schematic side view of the present invention.
Figure 6:
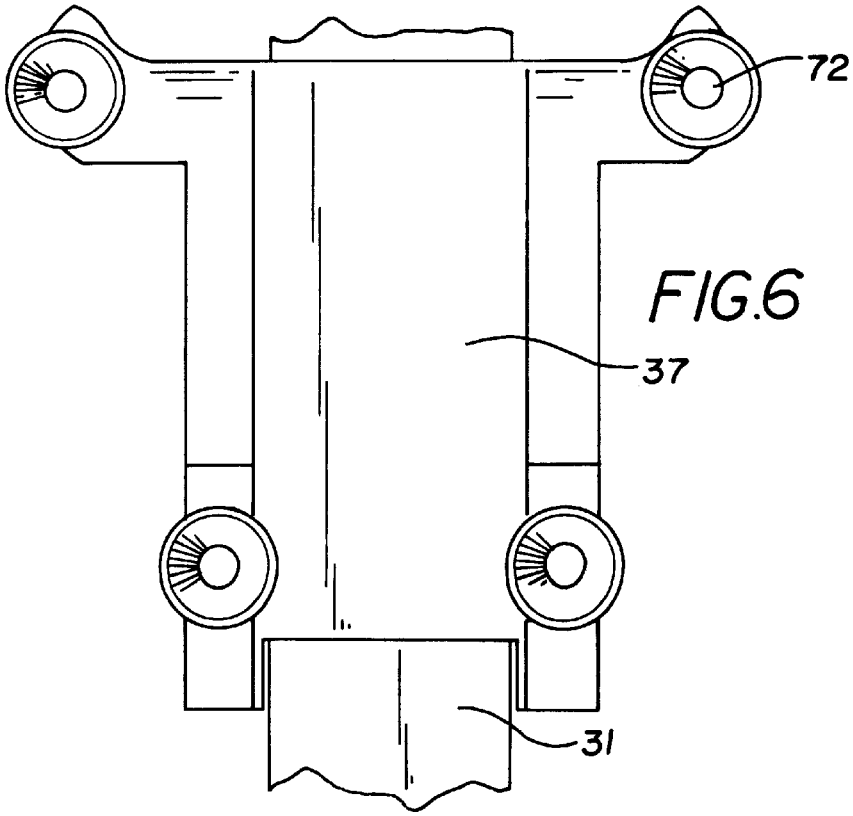
FIG. 6 is a schematic bottom view of the foot pedal and housing of the present invention.

With reference now to the drawings, and in particular to FIGS. 1 through 6 thereof, a new toilet flushing and seat lifting system embodying the principles and concepts of the present invention and generally designated by the reference numeral 10 will be described.

As best illustrated in FIGS. 1 through 6, the toilet flushing and seat lifting system 10 generally comprises a toilet 12. The toilet 12 has a base portion 13 and a tank portion 14. The base portion 13 has a bowl 15, a front side 16, a back side 17 and a bottom side 18. A seat 19 and lid 20 are hingedly coupled to the bowl 15. The seat 19 has a distal end 21 and a proximal end 22. The tank portion 14 has a handle 23 thereon for flushing the toilet 12.

A lifting means 30 for lifting the seat 19 and lid 20 of the toilet 12 includes a foot pedal 31. The foot pedal 31 is elongate and has a first 32 and second end 33. The foot pedal 31 is generally planar and is positioned generally adjacent to the bottom side 18 and between the front 16 and back 17 sides of the base portion of the toilet.

A conventional pivoting means pivots the foot pedal 31 with respect to the floor 34. The pivoting means is a fulcrum, not shown. A central portion of the foot pedal 31 is rotatably coupled to the fulcrum such that the first 32 and second 33 ends of the foot pedal 31 may selectively move away and towards the floor 34.

A housing 35 having a top side 36 and a bottom side 37 extends over the middle portion of the foot pedal 31 such that the first 32 and second 33 ends of the foot pedal 31 extend through opposite sides of the housing 35. The bottom side of the housing has fastening means 72 thereon for removably fastening the housing to the floor 31. Ideally the fastening means 72 are suction cups.

A flange 38 is integrally coupled to the first end 32 of the foot pedal 31. The flange 38 generally extends away from the foot pedal 31 and generally lies in a plane of the foot pedal 31 such that the foot pedal 31 and the flange 38 generally have a T-shape.

An elongate member 39 has a first end 40 and a second end 41. The first end 40 of the elongate member 39 is hingedly coupled to the second end 33 of the foot pedal 31. The elongate member 39 has a width generally between about 3 to 5 inches for stability and a length generally between 18 and 24 inches.

A rod 42 has a first end 43 and a second end 44. A portion of the rod, located generally adjacent to the first end 43, is fixedly coupled to the second end 41 of the elongate member 39. The second end 44 of the rod 42 is positioned generally between the seat 19 and the bowl 15 of the toilet 12. The rod 42, elongate member 39 and foot pedal 31 are preferably constructed of metal or rigid plastic.

A securing means 45 hingedly secures the rod 42 to a bottom side of the seat 19. The securing means 45 is located generally adjacent to the distal end 21 of the toilet seat 19. The securing means 45 has a base wall 46. The base wall has a front side 47, a back side abutted against the seat 19, a top edge 48 and a bottom edge 49. The back side is removably coupled to the bottom side the seat 19. A protruding member 50 is coupled to and extends away from a central area of the front side 47 of the base wall 46. The protruding member 50 has an aperture 51 therein for receiving the rod 42. The second end 44 of the rod 42 is insertable in the aperture 51. A guard wall 52 is integrally coupled to and extends away from the top edge 48 of the base wall 46. The guard wall 52 is orientated generally perpendicular to the base wall 48.

A toilet flushing means flushes the toilet 12 by actuating the handle 23 on the toilet 12. The toilet flushing means comprises an elongate flexible member 60 having a first end 61 and a second end 62. The first end 61 is coupled to the handle 23. A central portion of the elongate flexible member extends around the back side 17 of the toilet 12 on a ridge 63 extending away from the base portion 13. The second end 62 has a ring 64 thereon. The elongate flexible member 60 is preferably a cord.

In use, the user need only to step on the first end 32 of the foot pedal 31 in order to raise the toilet seat 19. The ring 64 may be placed anywhere convenient for flushing the toilet 12 without having to touch the handle 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet flushing and seat lifting system, said system being mountable to a toilet, the toilet having a base portion and a tank portion, the base portion having a bowl, a front side, a back side and a bottom side, a seat and lid being hingedly coupled to said bowl, said seat having a distal end and a proximal end, said tank portion having, a handle thereon for flushing said toilet, said system comprising:

a lifting means for lifting the seat and lid of the toilet, said lifting means comprising:

a foot pedal, said foot pedal being elongate and having a first and second end, said foot pedal being generally positionable adjacent to the bottom side of the toilet;

an elongate member, said elongate member having a first end and a second end, said first end of said elongate member being hingedly coupled to said second end of said foot pedal;

a rod, said rod having a first end coupled to said second end of said elongate member and a second end extending toward said toilet;

a securing means for hingedly securing said second end of said rod to a bottom side of the seat;

a toilet flushing means for flushing the toilet, said toilet flushing means comprising an elongate flexible member having a first end and a second end, said first end being couplable to said handle, said second end having a ring thereon;

a housing, said housing being having a top side and a bottom side, said housing extending over said middle portion of said foot pedal such that said first and second ends of said foot pedal extend through opposite sides of said housing;

said bottom side of said housing having a suction means thereon for removably fastening to said floor.

2. The toilet flushing and seat lifting system as in claim 1, wherein said foot pedal is pivotally coupled to said housing.

3. The toilet flushing and seat lifting system as in claim 1, wherein said foot pedal is generally planar; and a flange, said flange being integrally coupled to said first end of said foot pedal, said flange generally extending away from said foot pedal and generally lying in a plane of said foot pedal such that said foot pedal and said flange generally have a T-shape.

4. The toilet flushing and seat lifting system as in claim 1, wherein said elongate member has a width between approximately 3 to 5 inches.

5. The toilet flushing and seat lifting system as in claim 1, wherein said securing means is adapted for locating generally adjacent to said distal end of said toilet seat, said securing means having a base wall, said base wall having a front side, a back side, a top edge and a bottom edge, said back side being removably couplable to said bottom side of said seat, a protruding member being coupled to and extending away from a central area of said front side of said base wall, said protruding member having an aperture therein for receiving said rod.

6. The toilet flushing and seat lifting system as in claim 5, wherein said securing means comprises:

a guard wall being integrally coupled to and extending away from said top edge of said base wall, said guard wall being orientated generally perpendicular to said base wall.

7. A toilet flushing and seat lifting system, said system comprising:

a toilet, said toilet having a base portion and a tank portion, said base portion having a bowl, a front side, a back side and a bottom side, a seat and lid being hingedly coupled to said bowl, said seat having a distal end and a proximal end, said tank portion having a handle thereon for flushing said toilet;

a lifting means for lifting the seat and lid of the toilet, said lifting means comprising:

a foot pedal, said foot pedal being elongate and having a first and second end, said foot pedal being generally planar, said foot pedal being positioned generally adjacent to said bottom side and between said front and back sides of said base portion of said toilet;

a housing, said housing being having a top side and a bottom side, said housing extending over said middle portion of said foot pedal such that said first and second ends of said foot pedal extend through opposite sides of said housing, said bottom side of said housing having a suction means thereon for removably fastening to said floor;

said foot pedal being pivotally coupled to said housing:

a flange, said flange being integrally coupled to said first end of said foot pedal, said flange generally extending away from said foot pedal and generally lying in a plane of said foot pedal such that said foot pedal and said flange generally have a T-shape;

an elongate member, said elongate member having a first end and a second end, said first end of said elongate member being hingedly coupled to said second end of said foot pedal, said elongate member having a width generally equal to about 3 to 5 inches;

a rod, said rod having a first end and a second end, a portion of said rod located generally adjacent to said first end being fixedly coupled to said second end of said elongate member, said second end of said rod being positioned generally between said seat and said bowl of said toilet;

a securing means for hingedly securing said rod to a bottom side of said seat, said securing means being located generally adjacent to said distal end of said toilet seat, said securing means having a base wall, said base wall having a front side, a back side, a top edge and a bottom edge, said back side being removably coupled to said bottom side said seat, a protruding member being coupled to and extending away from a central area of said front side of said base wall, said protruding member having an aperture therein for receiving said rod, wherein said second end of said rod is insertable in said aperture, a guard wall being integrally coupled to and extending away from said top edge of said base wall, said guard wall being orientated generally perpendicular to said base wall; and a toilet flushing means for flushing the toilet, said toilet flushing means comprising an elongate flexible member having a first end and a second end, said first end being coupled to said handle, said second end having a ring thereon, said elongate flexible member being a cord.

8. A toilet flushing and seat lifting system, said system being mountable to a toilet, the toilet having a base portion and a tank portion, the base portion having a bowl, a front side, a back side and a bottom side, a seat and lid being hingedly coupled to said bowl, said seat having a distal end and a proximal end, said tank portion having a handle thereon for flushing said toilet, said system comprising:

a lifting means for lifting the seat and lid of the toilet, said lifting means comprising:

a foot pedal being elongate and having a first and second end, said foot pedal being generally positionable adjacent to the bottom side of the toilet;

an elongate member having a first end and a second end, said first end of said elongate member being hingedly coupled to said second end of said foot pedal;

a rod having a first end coupled to said second end of said elongate member and a second end extending toward said toilet;

a securing means for hingedly securing said second end of said rod to a bottom side of the seat;

a toilet flushing means for flushing the toilet, said toilet flushing means comprising an elongate flexible member having a first end and a second end, said first end being couplable to said handle, said second end having a ring thereon;

said securing means being locatable generally adjacent to said distal end of said toilet seat, said securing means having a base wall, said base wall having a front side, a back side, a top edge and a bottom edge, said back side being removably couplable to said bottom side of said seat, a protruding member being coupled to and extending away from a central area of said front side of said base wall, said protruding member having an aperture therein for receiving said rod.

9. The toilet flushing and seat lifting system as in claim 8, wherein said foot pedal is pivotally coupled to a housing.

10. The toilet flushing and seat lifting system as in claim, wherein said foot pedal is generally planar; and additionally comprising a flange being integrally coupled to said first end of said foot pedal, said flange generally extending away from said foot pedal and generally lying in a plane of said foot pedal such that said foot pedal and said flange generally have a T-shape.

11. The toilet flushing and seat lifting system as in claim 8, wherein said elongate member has a width between approximately 3 to 5 inches.

12. The toilet flushing and seat lifting system as in claim 8, wherein said securing means comprises a guard wall being integrally coupled to and extending away from said top edge of said base wall, said guard wall being orientated generally perpendicular to said base wall.

* * * * *